US006260374B1

(12) United States Patent
Smith et al.

(10) Patent No.: US 6,260,374 B1
(45) Date of Patent: Jul. 17, 2001

(54) EASILY INSTALLABLE FIELD CONFIGURABLE AIR CONDITIONING UNIT

(75) Inventors: Mark E. Smith, deceased, late of Waco, by Carol Susan Smith, executor; Howard W. Newton, McGregor; Armando A. Villafana, Waco, all of TX (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/558,768

(22) Filed: Apr. 26, 2000

(51) Int. Cl.[7] ..... F25D 19/00
(52) U.S. Cl. ..... 62/298; 62/244
(58) Field of Search ..... 62/298, 244

(56) References Cited

U.S. PATENT DOCUMENTS 3,906,740 * 9/1975 Thomas ..... 62/239
4,527,762 7/1985 Duell .
4,747,505 5/1988 Hansen .
4,862,953 9/1989 Granetzke et al. .
4,900,108 2/1990 Tischer .
5,713,651 2/1998 Essig et al. .
5,987,908 * 11/1999 Wetzel ..... 62/259.1
6,065,296 * 5/2000 Feger ..... 62/77
6,109,054 * 8/2000 Han ..... 62/317
6,202,426 * 3/2001 Matsunaga et al. ..... 62/125

* cited by examiner

*Primary Examiner*—William Doerrler
*Assistant Examiner*—Mark Shulman
(74) *Attorney, Agent, or Firm*—William J. Beres; William O'Driscoll; Peter D. Ferguson

(57) ABSTRACT

An air conditioning unit. The unit comprises a housing having a first side, a second side, a return air end wall, a supply air end wall, a return air interior, a supply air interior and a heat exchange coil operably connected to the first and second sides and separating the return air and supply air interiors. The first side includes a return air aperture and a supply air aperture, and the second side includes a return air aperture and a supply air aperture. The supply air end wall includes a supply air aperture wherein the supply air and return air apertures are of identical configuration. The air conditioning unit also includes chamfered corners, and a hanger assembly and a U-shaped channel bracket located at each chamfered corner.

20 Claims, 5 Drawing Sheets

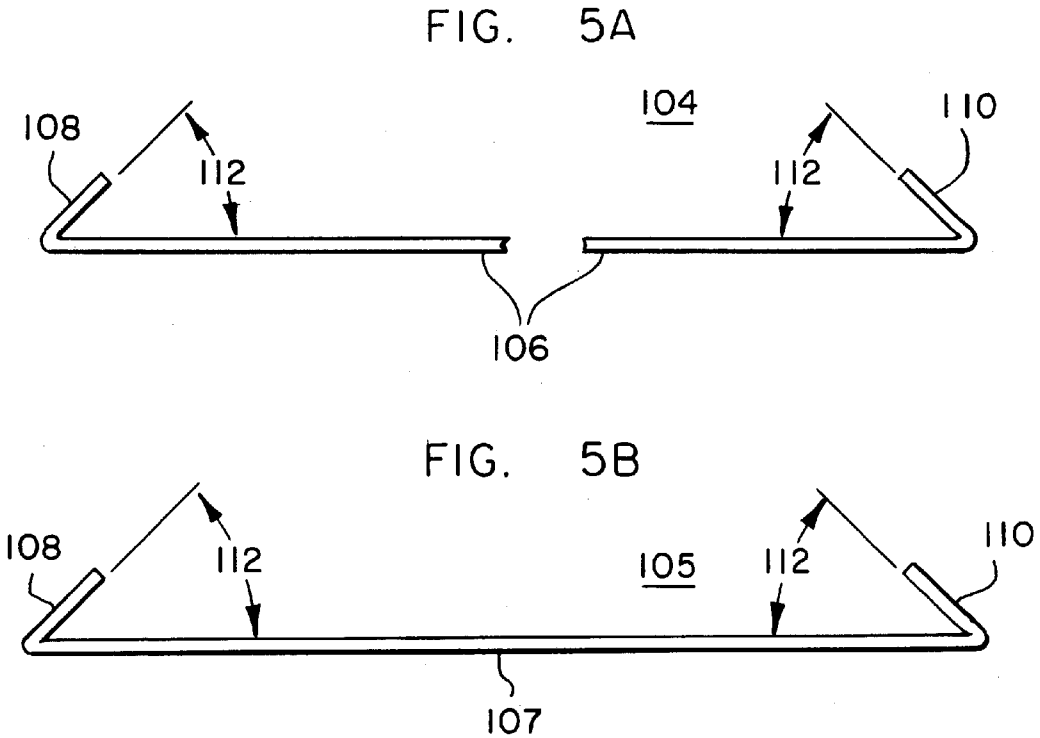
FIG. 5A
FIG. 5B
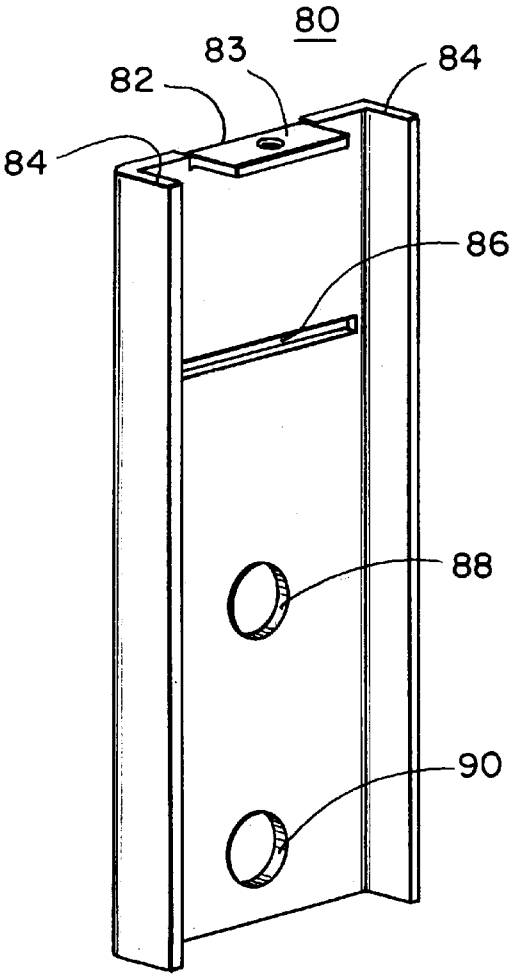
FIG. 4

EASILY INSTALLABLE FIELD CONFIGURABLE AIR CONDITIONING UNIT

BACKGROUND OF THE INVENTION

The present invention is directed to air conditioning units, particularly terminal devices, that must be positioned while being installed and which have a variety of potential airflow paths.

Air conditioning units which act as a terminal device for cooling systems include water source heat pumps, water cooled package units and air handlers. Typically, return air enters these units from any one of several sides, is conditioned, and exits the unit from any one of several sides. In the past, the installer was required to stock each potential configuration, sometimes requiring the installer to stock six differing but very similar terminal devices.

Additionally, during installation it is usually necessary to position the air conditioning unit while attaching some sort of fastener. This often requires several installers and may be awkward, particularly where the air conditioning unit is suspended from a high ceiling.

SUMMARY OF THE INVENTION

It is an object, feature and advantage of the present invention to solve the problems with installation and configuration of previous air conditioning units.

It is an object, feature and advantage of the present invention to provide an air conditioning unit that is field configurable.

It is an object, feature and advantage of the present invention to provide an air conditioning unit that is easily installable and which is self supporting upon installation.

It is a further object, feature and advantage of the present invention to provide an installation mechanism which also serves as a vibration isolator.

It is a further object, feature and advantage of the present invention to provide an installation mechanism which will support a suspended air conditioning unit even if the mechanism is not securely fastened to the air conditioning unit.

It is an object, feature and advantage of the present invention to provide an air conditioning unit having an airflow path therethrough which can be reconfigured by an installer to allow return air to enter on one of several sides and supply air to exit upon one of several sides.

It is a further object, feature and advantage of the present invention that this reconfigurable air conditioning unit be horizontally orientated and have at least two return air options and at least three supply air exit options.

It is a further object, feature and advantage of the present invention that a heat exchange coil be located in the airflow path between the return air options and the supply air options.

It is an object, feature and advantage of the present invention to provide a horizontal water source heat pump having an octagonal shape when viewed from a vertical direction.

It is an object, feature and advantage of the present invention to provide an air conditioning unit having chamfered corners which allow integral hanging brackets to remain within the rectangular overall shape of the unit.

It is an object, feature and advantage of the present invention to provide an integral hanging bracket for an air conditioning unit where the integral hanging bracket does not increase the footprint of the unit.

It is a further object, feature and advantage of the present invention to provide a hanging bracket which attached in such a manner that the unit screws can be removed and the unit still hangs.

It is an object, feature and advantage of the present invention to provide a horizontal water source heat pump or cooling only unit including an air coil internal to the unit cabinet.

It is a further object, feature and advantage of the present invention to allow an installer to reconfigure the airflow path for the unit to allow a left air return path, a right air return path, or the combination of both a right air and left air return path.

It is a further object, feature and advantage of the present invention to allow that installer to select from a supply air left side, right side, or back supply air path either low or high fan discharge in each of those paths.

It is an object, feature and advantage of the present invention to provide an air conditioning cabinet design minimizing production errors.

It is a further object, feature and advantage of the cabinet design that all components are built the same, independent of air paths and thereby maximizing the old convertibility for airflow path changes.

The present invention provides a bracket for an air conditioning unit. The bracket comprises a substantially planar middle portion having first and second ends; a first end portion of the middle portion extending in a first direction substantially perpendicular to the plane of the middle portion; and a second end portion operatively attached to the middle portion at a second end, and extending in a second direction substantially opposite the first direction.

The present invention further provides a bracket for an air conditioning unit. The bracket comprises a vertical portion having a first upper end and a second lower end; a horizontal portion operably connected to and extending from the first end in a first direction to a peripheral end; a horizontal portion operably connected to and extending from the second end in a direction substantially opposite the first direction; and a vibration isolator operably connected to the peripheral end and extending in a third direction substantially perpendicular to the first direction.

The present invention also provides an air conditioning unit. The air conditioning unit comprises a housing having a first side, a second side, a return air end wall, a supply air end wall, and a return air interior and a supply air interior and a heat exchange coil operably connected to the first and second sides and separating the return air and supply air interiors. The first side includes a return air aperture and a supply air aperture. The second side includes a return air aperture and a supply air aperture. The supply air end wall includes a supply air aperture wherein the supply air and return air apertures are of identical configuration.

The present invention additionally provides an air conditioning unit. The air conditioning unit comprises a housing having first and second sides, first and second ends, and an interior between said sides and ends. Each side has a return air and a supply air section, and the first end includes a supply air section. A heat exchange coil is located within the housing and arranged to divide the interior into a return air portion and a supply air portion such that the return air sections of the first and second sides are co-extensive with the return air portion and the supply air sections of the first and second sides and the first end are coextensive with the supply air portion. The supply air sections are of substantially identical size and shape, and further including a common panel sized to cover at least one supply air section. The return air sections are of substantially identical size and shape, with a profile like the supply air sections but larger in width.

BRIEF DESCRIPTION OF THE DRAWINGS

FIG. 4 is a perspective of the corner bracket of the present invention.

FIG. 5A is a top diagram of a return air panel in accordance with the present invention.

FIG. 5B is a top diagram of a supply air panel in accordance with the present invention.

DETAILED DESCRIPTION OF THE DRAWING

Figure 1:
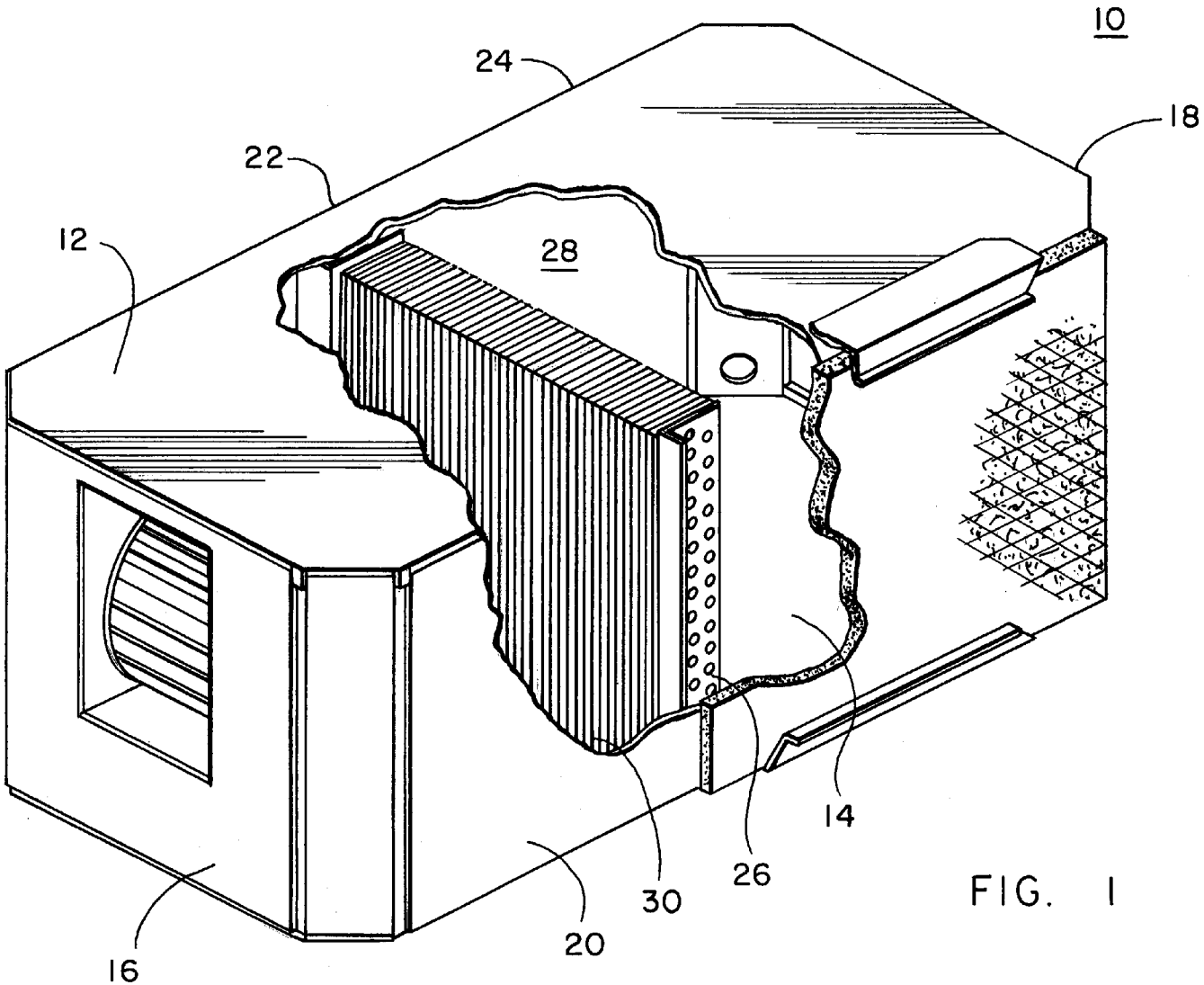
FIG. 1 is a perspective view of an air conditioning unit in accordance with the present invention with a partial cutaway showing the interior and heat exchange coil.

FIG. 1 shows an air conditioning unit 10 in accordance with the present invention. In the preferred embodiment, the air conditioning unit 10 is a water source heat pump but other terminal air conditioning units and air handlers are also contemplated to fall within the spirit and scope of the claimed invention.

The air conditioning unit 10 includes a top 12, a bottom 14, a supply air end 16, a return air end 18 which provides access to a compressor 36 and a controller (not shown), a first side 20 and a second side 22. The top 12, the bottom 14, the first and second sides 20, 22 and the supply and return ends 16 and 18 are joined to form a housing 24. A heat exchange coil 26 is arranged in the housing so as to divide the interior of the housing 24 into a return air space 28 and a supply air space 30. The heat exchange coil 26 is preferably a fin tube coil but other conventional heat exchanger coil exchanging heat between a fluid within the coil and air flowing over the coil are also contemplated.

The heat exchange coil 26 has an output connection 32 connected by heat exchange tubing 34 to a compressor 36. The compressor is connected by tubing 38 to a heat exchanger 40. The heat exchanger 40 has an output 42 connected by heat exchange tubing 44 to an expansion device 46. The expansion device is connected by tubing 48 to an input 50 of the heat exchange coil 26. The heat exchange coil 26, the compressor 36, the heat exchange coil 40, the expansion device 46 and the tubing 34, 38, 44 and 48 form a heat pump system 56 shown in a cooling mode. A reversing valve and tubing (not shown) are included to reconfigure the heat pump system 56 into a heating mode of operation. The heat exchange coil 40 is preferably implemented as a shell and tube heat exchanger allowing fluid to fluid heat exchange between a refrigerant and the heat pump system 56 and a fluid entering through tubing 58 and exiting through tube 60. The heat pump system 56 is available from The Trane Company through its Model GEH heat pump.

The present invention is directed to the ease of installation and configuration of the air conditioning unit 10.

The compressor 36 and the heat exchange coil 40 are located in the return air interior 28 within a sealed enclosure 62.

Figure 3:
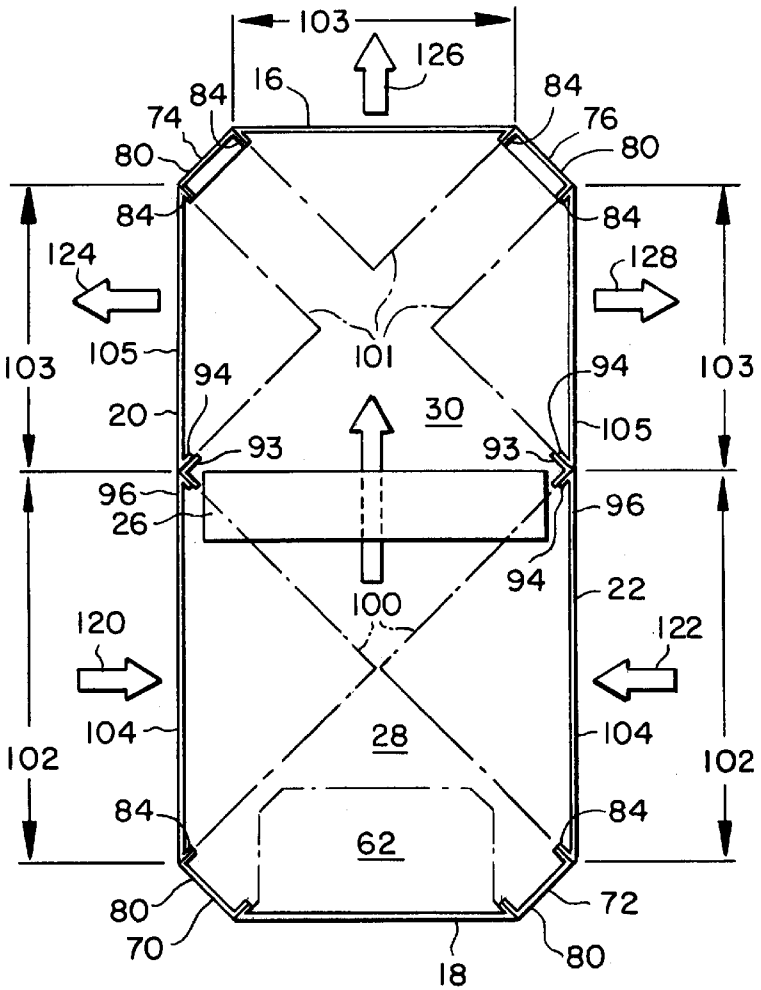
FIG. 3 is a top diagram of the present invention showing all of the potential airflow paths.

Referring now to FIG. 3, it can be seen that the air conditioning unit 10, from a top view, has chamfered corners 70, 72, 74 and 76 such that the air conditioning unit 10 has eight sides 16, 18, 20, 22, 70, 72, 74 and 76.

The structure 62 is mounted on the return air wall 18 to the flanges 84 of the corners 70, 72.

FIG. 4 is chamfered corner 70, 72, 74, 76 are formed using a U-shaped vertical support 80. The support 80 includes a flat face portion 82 with vertically arranged flanges 84 on either side of the face portion 82. The support 80 may also include a horizontal flange 83 for attachment to the top 12 using conventional fasteners. The flanges 84 are preferably at a right angle to the face portion 82 so as to give the support 80 a U-shaped profile when viewed from above. The face portion includes a bracket aperture 86 preferably configured as a slot. The face portion 82 may also include connection apertures 88 and 90 which allow electrical, refrigerant, or drain connections to be made through the face portion 82. When the portion 80 is installed as a chamfered corner 70, 72, 74, 76, the flanges 84 form a 135° angle relative to the adjacent sides 20, 22 and end walls 16, 18.

Center supports 93 having opposed 135° flanges 94 are provided in the first and second sides 20, 22 at the outside ends 96 of the coil 26. In the return air space 28, the peripheral flanges 84 and the support flanges 94 form equilateral triangles 100 where each of the equilateral triangles 100 is identical with respect to the return air space 28 such that the length of their bases 102 are the same. Since the bases 102, of the equilateral triangles 100 are all the same, a common return air side panel 104 may be used. With respect to the supply air space 30, the peripheral flanges 84 and the support flanges form equilateral triangles 101 where each of the triangles 101 is identical with respect to the supply air space 30 such that the length of their bases 103 are the same. Since the bases 103 of the equilateral triangles 101 are the same, a common supply air panel 105 may be used.

The return air side panel 104 is shown in FIG. 5A and the supply air panel 105 is shown in FIG. 5B. The panels 104, 105 are substantially similar and have a similar profile with the exception of their width, and like reference numerals are used to indicate like elements. The return air panel 104 includes a panel face 106, a first angled end portion 108 and a second angled end portion 110. The angled end portions 108 and 110 are angled towards each other at a similar angle 112. This angle is preferably 135° such that the end flanges 108, 110 smoothly engage the flanges 84 and 94. The supply air panel 105 includes a panel face 107, a first angled end portion 108 and a second angled end portion 110. The angled end portion 108 and 110 are angled towards each other at a similar angle 112. This angle is preferably 135° such that the end flanges 108, 110 smoothly engage the flanges 84 and 94. The face 106 of the return air panel 104 is wider than the face 107 of the supply air panel 105.

Since the supply air panels 105 are identical and return air panels 104 are all identical, an air conditioning unit 10 can be shipped with three such panels (two supply air panels 105 and one return air panel 104) and an installer can rearrange the panels to provide a desired airflow path. The return air interior 28 is blocked off by the structure 62 and a return air panel 104 installed on either the first 20 or the second side 22 but not both sides 20, 22. This allows air to enter the return air interior 28 from the first side 20 as indicated by arrow 120 or from the second side 22 as indicated by the arrow 122. The return air enters the return air interior 28 and passes through the coil 26 into the supply air interior 30. A pair of supply air panels 105 are used to block off any of the three potential exits from the supply air interior 30 such that air can exit from one of the first side 20, the second side 22, or the supply air end wall 16. The supply air can exit as indicated by arrows 124, 126 and 128.

Figure 2:
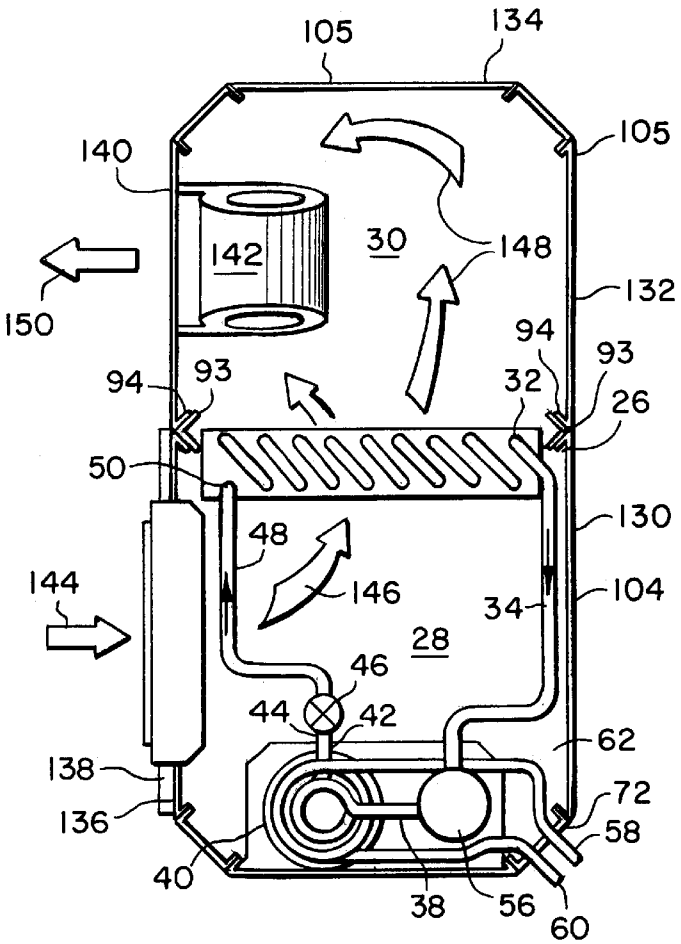
FIG. 2 is a top view of diagram of the present invention including an airflow path.
Figure 7:
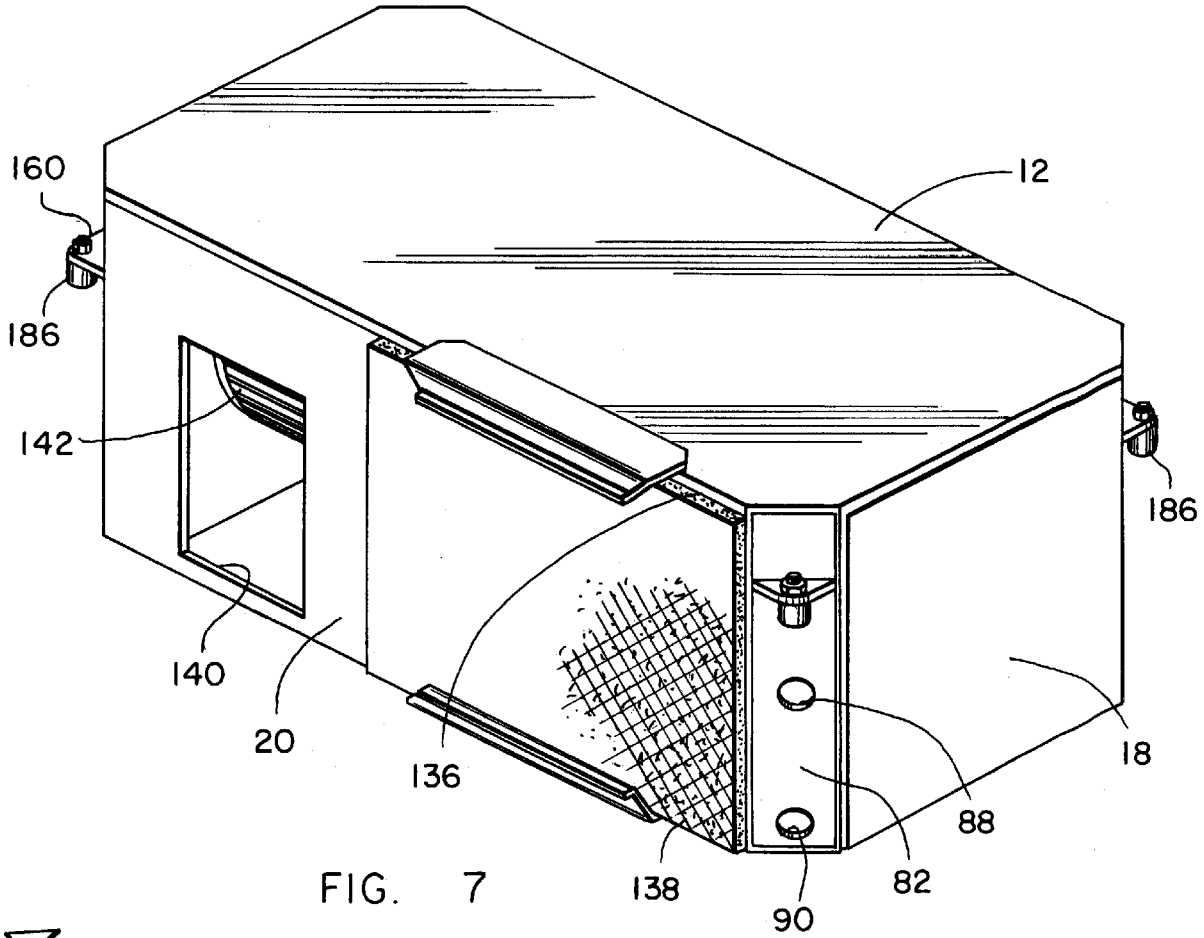
FIG. 7 is a perspective of the air conditioning unit of the present invention showing the hanger assembly in position.
Figure 6:
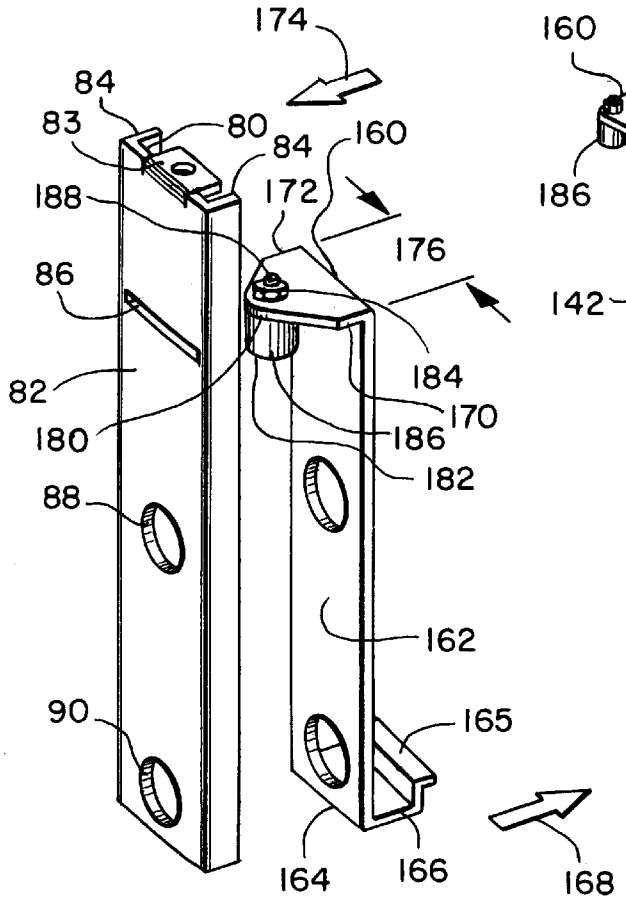
FIG. 6 is a perspective of the hanger assembly in accordance with the present invention.

FIG. 2 is configured such that a return air aperture 130 is blocked by a return air panel 104 and potential supply air apertures 132 and 134 are blocked by supply air panels 105. A return air aperture 136 is covered by a filter 138 but is accessible to airflow. A supply air aperture 140 is open and a blower 142 is preferably mounted to impel air from the interior 30 out the aperture 140. Thus the airflow through the air conditioning unit 10 follows the sequence indicated by arrows 144, 146, 148 and 150.

However, the installer could just as easily have configured the airflow to flow out the supply air aperture 132 and have blocked off the supply air aperture 140. Similarly, the airflow could be through the return air aperture 130 and out the supply air aperture 134 with the remaining apertures 132, 140 and 136 being blocked off by panels 104 and 105. Depending on the required airflow, installers had to determine the requisite numbers of each of the six separate configurations, install each after determining where each of the units must go. In the present arrangement, the installer can order a single unit and the distributor is only required to carry that single unit. The installer has the flexibility of reconfiguring the unit 10 into the desired airflow path since the unit 10 has a pair of identical return air apertures 130, 136 which allow airflow into either aperture across the coil 26 and then out of any one of three identical supply air apertures 132, 134 and 140.

The ease of installation is further facilitated by a unique hanging bracket 160, with an overall elongated z-shape when viewed edge on from the side, which is adapted for use with the vertical channels 80.

The hanging bracket 160 includes a substantially planar middle portion 162 which is vertically arranged upon installation. At a bottom end 164 of the middle portion 162 is attached a base 166 extending in a first direction 168 which is substantially at a right angle to the planar portion 162 and may include a flange 165. The middle portion 162 includes an upper end 170 including a hanging flange 172. The hanging flange extends from the middle portion 162 in a direction 174 substantially opposite that of direction 168. The hanger flange has a width 176 adapted to fit within the hanger aperture 86 and includes a chamfered end portion 180. The chamfer of the chamfered end portion 180 is angled such that the chamfered portion 180 falls within a rectangle formed by adjacent side or end walls 16, 18, 20, 22. This allows the unit 10 to be shipped within a rectangular box or pallet without projections. An insulator assembly 182 extends through an aperture 184 in the chamfered portion 180. The insulator assembly includes an insulator 186 and conventional fastener assembly 188.

Upper bracket and lower bracket are attached to the respective top 12 and bottom 14 to support the filter 138 and allow horizontal removal.

Figure 8:
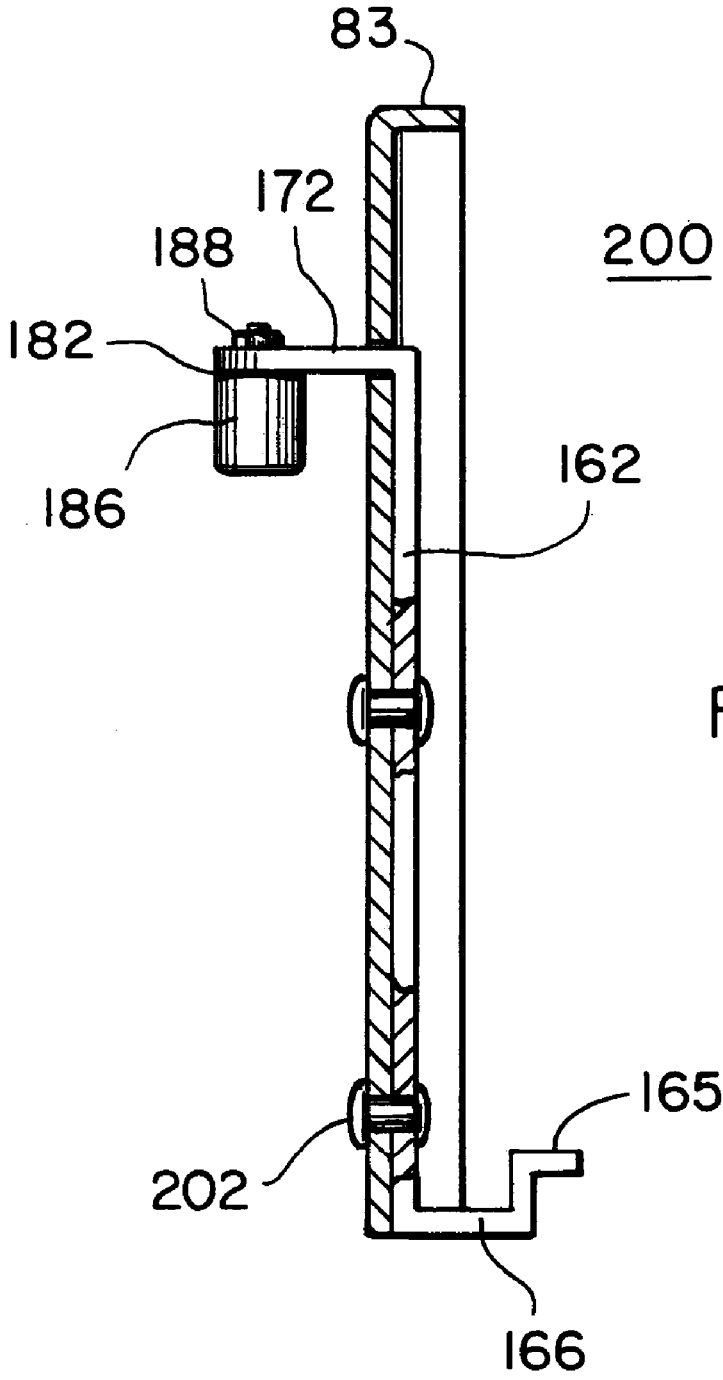
FIG. 8 is a side view of a hanger assembly in accordance with the present invention.

As shown in FIG. 8, a hanger assembly 200 is formed by inserting the chamfered end 180 of the hanger bracket 160 through the hanger aperture 86 of the channel 80. The insulator assembly 182 is then added to the chamfered end 180 and a fastener 202 such as a pop rivet, screw, or bolt and nut is used to secure the hanger bracket 160 to the channel 180. The hanger assembly 200 is such that the fastener 202 is not required and the weight of the unit 10 can be held by the unsecured hanger assembly 200. Typically, this is accomplished by placing the insulator 186 into a mating receptacle or upon a receiving pin depending upon the installation arrangement.

The present invention describes an easily installable field configurable air conditioning unit with a hanger assembly that will support the unit even when the hanger assemblies fasteners and/or the panels 104, 105 are removed. The hanger assembly includes a vibration isolator, and the unit has an airflow path that is easily reconfigurable by a field installer to select from one or more of several return air paths and from one or more supply air paths. A person of ordinary skill in the art will recognize that the air conditioning unit can be varied from the Preferred Embodiment described herein. Additionally, other modifications and alterations to such a person and all such modifications and alterations are contemplated to fall within the spirit and scope of the claimed invention.

What is desired to be secured for Letters Patent of the United States is set forth in the following claims:

1. A bracket for an air conditioning unit comprising:

a substantially planar middle portion having first and second ends;

a first end portion of the middle portion extending in a first direction substantially perpendicular to the plane of the middle portion; and a second end portion operatively attached to the middle portion at a second end, and extending in a second direction substantially opposite the first direction.

2. The bracket of claim 1 wherein the second end portion has a chamfered profile.

3. The bracket of claim 2 wherein an insulator is attached to the second end portion.

4. The bracket of claim 3 wherein the air conditioning unit is a water source heat pump arranged in a horizontal orientation.

5. The bracket of claim 2 wherein the bracket supports the air conditioning unit without fasteners.

6. The bracket of claim 5 wherein the bracket has an overall Z-shape.

7. The bracket of claim 6 wherein the air conditioning unit includes a U-shaped support having an aperture adapted to receive the second end portion.

8. A bracket for an air conditioning unit comprising:

a vertical portion having a first upper end and a second lower end;

a horizontal portion operably connected to and extending from the first end in a first direction to a peripheral end;

a horizontal portion operably connected to and extending from the second end in a direction substantially opposite the first direction;

a vibration isolator operably connected to the peripheral end and extending in a third direction substantially perpendicular to the first direction.

9. An air conditioning unit comprising:

a housing having a first side, a second side, a return air end wall, a supply air end wall, and a return air interior and a supply air interior and a heat exchange coil operably connected to the first and second sides and separating the return air and supply air interiors;

wherein the first side includes a return air aperture and a supply air aperture, and the second side includes a return air aperture and a supply air aperture, and the supply air end wall includes a supply air aperture wherein the supply air and return air apertures are of identical configuration.

10. The air conditioning unit of claim 9 wherein the air conditioning unit has an octagonal shape when viewed from a vertical direction.

11. The air conditioning unit of claim 10 wherein the air conditioning unit includes chamfered corners.

12. The air conditioning unit of claim 11 wherein a hanger assembly and a U-shaped channel bracket are located at each chamfered corner.

13. The air conditioning unit of claim 12 including interchangeable side panels adapted to block at least one of the return air and supply air apertures of the first side, the second side, or the end wall.

14. The air conditioning unit of claim 13 where the side panels have a mount including a 45° flange relative to a plane of the side panel.

15. The air conditioning unit of claim 14 wherein the side panel flange engages the U-bracket of the chamfered corner.

16. The air conditioning unit of claim 15 wherein the U-channel includes a slot.

17. The air conditioning unit of claim 16 wherein the hanging bracket extends through the slot.

18. The air conditioning unit of claim 17 further including a vibration isolator attached to the hanging bracket.

19. An air conditioning unit comprising:

a housing having first and second sides, first and second ends, and an interior between said sides and ends, each side having a return air and a supply air section, and the first air end including a supply air section;

a heat exchange coil located within the housing and arranged to divide the interior into a return air portion and a supply air portion such that the return air sections of the first and second sides are co-extensive with the return air portion and the supply air sections of the first and second sides and the first end are coextensive with the supply air portion;

wherein the supply air sections are of substantially identical size and shape and further including a common panel sized to cover at least one supply air section; and wherein the return air sections are of substantially identical size and shape.

20. The air conditioning unit of claim 19 further including an airflow path entering at least one return air section, passing through the heat exchange coil, and exiting a single supply air section.

* * * * *